US007357277B2

(12) United States Patent
Verespej et al.

(10) Patent No.: US 7,357,277 B2
(45) Date of Patent: Apr. 15, 2008

(54) CAP ASSEMBLY AND CONTAINER USED THEREWITH

(75) Inventors: Rocklin Verespej, Lake Forest, CA (US); Luke Hartman, Garden Grove, CA (US); Craig F. Knaack, Arlington Heights, IL (US); David Slevin, Chicago, IL (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 11/483,712

(22) Filed: Jul. 10, 2006

(65) Prior Publication Data

US 2006/0249533 A1 Nov. 9, 2006

Related U.S. Application Data

(63) Continuation-in-part of application No. 10/929,663, filed on Aug. 30, 2004.

(51) Int. Cl.
*B67B 5/00* (2006.01)

(52) U.S. Cl. ..... 222/153.01; 220/251.4; 222/81

(58) Field of Classification Search ..... 222/153.01, 222/80, 81, 82, 541.1, 255.1, 258.1, 258.2–258.5, 222/541.2, 541.6, 541.7, 566–572, 541.8, 222/100, 105, 106; 141/352, 354, 364; 220/265–270
See application file for complete search history.

(56) References Cited

U.S. PATENT DOCUMENTS 4,375,864 A * 3/1983 Savage ..... 222/81
5,392,939 A * 2/1995 Hidding et al. ..... 215/265
5,566,851 A * 10/1996 Sasaki et al. ..... 229/117.27
5,609,195 A * 3/1997 Stricklin et al. ..... 141/346
5,875,942 A * 3/1999 Ohmi et al. ..... 222/556
6,308,849 B1 * 10/2001 Kim ..... 215/303
6,408,904 B1 * 6/2002 Dushman ..... 141/352

* cited by examiner

*Primary Examiner*—Lien M. Ngo
(74) *Attorney, Agent, or Firm*—The Watson IP Group; Jovan N. Jovanovie; Vladan M. Vasiljevie

(57) ABSTRACT

A container assembly having a container, a fitment and a cap assembly. The container has at least one panel and at least one seal sealing the at least one panel to define a cavity. The fitment is coupled with the container, comprising a body having a first end and a second end. The second end extends away from the container, wherein the fitment provides fluid communication with the cavity. The cap assembly is releasably attachable to the second end of the fitment. The cap assembly comprises a base and a cover. The base includes an upper surface, a lower surface and an opening extending therethrough. The opening including an upper annular rim extending from the upper surface of the base and a lower annular rim extending from the lower surface of the base. The cover is attachable to the base to cover the opening. The cover includes an annular ring that extends along at least a portion of the upper annular rim of the opening. The annular ring forms a hermetic seal with the upper annular rim of the opening. A frangible cover is integrally molded with the cap extending across the lower annular rim.

20 Claims, 8 Drawing Sheets

CAP ASSEMBLY AND CONTAINER USED THEREWITH

This application is a continuation in part of U.S. patent application Ser. No. 10/929,663 filed Aug. 30, 2004 entitled "Cap Assembly and Container Used Therewith", the entire specification of which is incorporated by reference.

BACKGROUND OF THE INVENTION

1. Field of the Invention

The present invention relates in general to a cap assembly, and more particularly, to a cap assembly capable of hermetically sealing a container assembly, the cap assembly undergoing sterilization processes with superheated steam at temperatures in excess of 280° F. Such sterilization processes are generally suitable for filling of food grade flowable material including low acid flowable material. Of course, the invention is not limited to any particular flowable material.

2. Background Art

The use of flexible containers for the shipment and dispensing of flowable material has greatly increased in recent years. Increasingly, flexible containers are common for food grade products. Among other procedures, it is necessary to properly sterilize the containers to minimize contamination and to maximize shelf life of the products within the containers. While the sterilization of containers for high acid products has been readily achieved, there have been problems associated with low acid applications. This is because high acid products have an inherent advantage; microbes and microorganism have difficulty surviving and reproducing in highly acidic materials.

The same is not true for low acid materials. In particular, microbes and microorganisms can thrive in a low acid environment. For this reason, the sterilization procedures for containers utilized in low acid environments are substantially more rigorous than for high acid environments. In a low acid filling process, for example, prior to and after filling, a spout assembly is exposed to superheated steam for a predetermined period of time. For example, at a temperature of 280° F., sterilization is achieved after 13 seconds (the steam is at approximately 30 psi). At 290° F., sterilization is reached in about 3.6 seconds. At in excess of 300° F., sterilization is reached in about 1 second. Temperatures as high as 307° F. and higher (pressure of approximately 60 psi) are utilized to achieve quick sterilization of components.

Providing covers for fitments which are both suitable for use in low acid conditions, and which include openings extending therethrough for dispensing purposes cannot substantially withstand the sanitizing environment has proven difficult. First, the seal over the dispensing opening often fails during the sanitizing procedure. In other situations, the covers deform in such an environment to the extent that the cover dislodges or otherwise disengages from the fitment. In either case, the end result is that the material within the container is destroyed and must be discarded.

Inasmuch as such sanitizing is highly destructive to fitments and covers, containers used for low acid applications generally include two separate fitments. The fitment within which product is to be filled generally includes a cap member free of openings. A second fitment is provided on the container for dispensing. Such a fitment includes a cap member which is capable of receiving various different dispensers for coupling therewith. Inasmuch as no manipulation or removal of the second (dispensing) fitment is required during filling of the container, the second fitment does not undergo the sanitizing procedures described above. Problematically, the use of two separate fitments increases the cost of the containers, the assembly of the containers and the ease of manipulation of the containers. Furthermore, the greater use of components leads to increased container failure rates.

Accordingly, it is an object of the invention to provide a cover member for a flexible container which includes a dispensing means and which can survive sterilization procedures for low acid applications.

It is another object of the invention to provide a cover member which can be adapted for receipt of a number of different dispensers which can survive sterilization procedures for low acid applications.

It is another object of the invention to provide a frangible cover over a portion of the cap, wherein the frangible cover is pierced by a probe or other object to initiate the dispensing of flowable material from within the container.

These and other objects of the invention will become apparent in light of the specification and claims appended hereto.

SUMMARY OF THE INVENTION

The invention comprises a container assembly, having a container, a fitment and a cap assembly. The container has at least one panel and at least one seal sealing the at least one panel to define a cavity. The fitment is coupled with the container, comprising a body having a first end and a second end. The second end extends away from the container, wherein the fitment provides fluid communication with the cavity. The cap assembly is releasably attachable to the second end of the fitment. The cap assembly comprises a base and a cover. The base includes an upper surface, a lower surface and an opening extending therethrough. The opening includes an upper annular rim extending from the upper surface of the base and a lower annular rim extending from the lower surface of the base. The cover is attachable to the base to cover the opening. The cover includes an annular ring that extends along at least a portion of the upper annular rim. The annular ring forms a hermetic seal with the upper annular rim of the opening. A frangible cover is integrally molded with the cap and extends across the lower annular rim.

In a preferred embodiment, the frangible cover further comprises a frangible cover body having a central region and an outer perimeter. The central region includes a central thickness. The outer perimeter includes an outer perimeter thickness. The central thickness is greater than the outer perimeter thickness.

In another preferred embodiment, the central thickness is at least twice that of the outer thickness.

In another preferred embodiment, the frangible cover body includes a diameter. The body tapers from the central thickness to the outer perimeter thickness predominantly within the outer third of the diameter of the body. In one such preferred embodiment, the taper occurs within an outer eighth of the diameter body.

In a preferred embodiment, the frangible cover is formed by directing material through a porous mold, or through coining.

In another preferred embodiment, the cover comprises a body, an arm and a hinge. The body has an upper surface and a lower surface. The arm extends from the body. The hinge is attached to each of the body and the cap assembly to permit hinged engagement of the cover to the cap assembly.

In a preferred embodiment, the cap assembly is configured for maintaining the hermetic seal after exposure to superheated steam of a temperature of at least 280° F. for a predetermined period of time adequate to achieve sterilization.

In another preferred embodiment of the invention, the invention comprises a cap assembly releasably attachable to the second end of the fitment. The cap assembly comprises a base and a cover. The base includes an upper surface, a lower surface and an opening extending therethrough. The opening includes an upper annular rim extending from the upper surface of the base and a lower annular rim extending from the lower surface of the base. The cover is attachable to the base to cover the opening. The cover includes an annular ring that extends along at least a portion of the upper annular rim. The annular ring forms a hermetic seal with the upper annular rim of the opening. A frangible cover is integrally molded with the cap and extends across the lower annular rim.

The invention further comprises a method of utilizing a container assembly suitable for use in association with the filling and dispensing of low acid flowable food material. The method comprises the steps of: providing a container assembly filled with a flowable material; positioning the cover in a second open orientation relative to the opening of the base; forcing a probe through the opening of the base; piercing the frangible cover of the cap; and dispensing the flowable material from within the cavity through the probe.

In a preferred embodiment, the step of piercing the frangible cover further comprises the step of separating the frangible cover from the cap in a single piece such that it will not pass through the opening and the probe with the dispensing of the flowable material.

In yet another preferred embodiment, the step of providing further comprises the step of providing a gamma irradiated container assembly filled with a flowable material.

In another preferred embodiment, the step of providing further comprises the step of providing a container assembly filled with a flowable material, wherein the container was sterilized with steam at a temperature in excess of 280° F.

BRIEF DESCRIPTION OF THE DRAWINGS

The invention will now be described with reference to the drawings wherein.

DETAILED DESCRIPTION OF THE INVENTION

Figure 1:
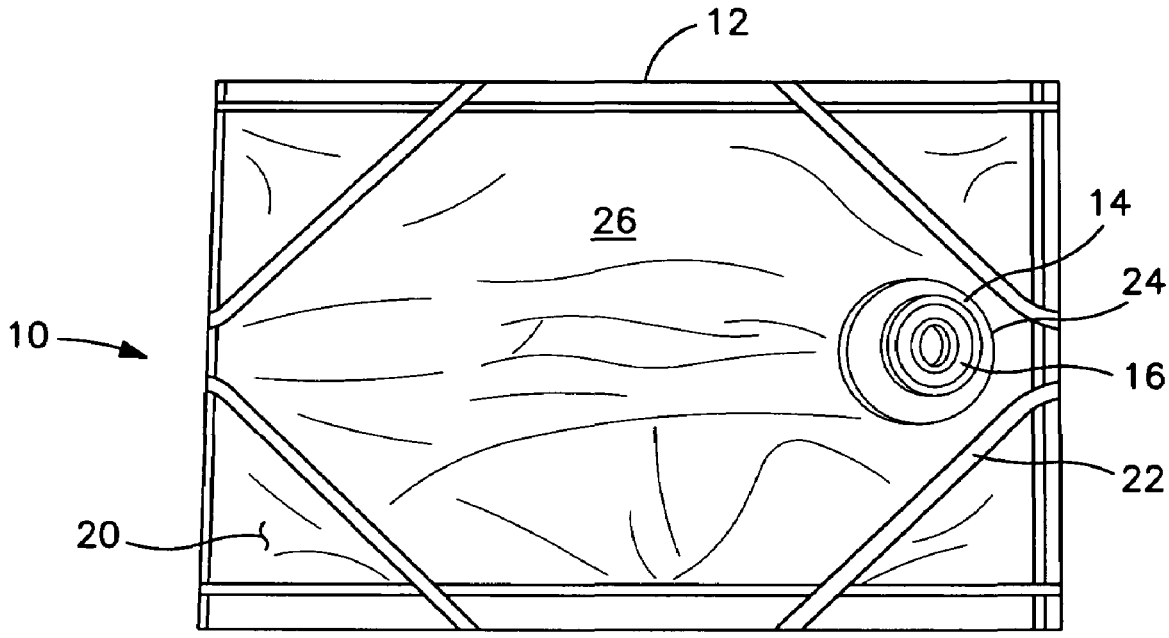
FIG. 1 of the drawings comprises a top plain view of the container assembly of the present invention.

While this invention is susceptible of embodiment in many different forms, there is shown, in the drawings, several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters. In addition, it will be understood that the drawings are merely representations of the present invention, and some of the components may have been distorted from actual scale for purposes of pictorial clarity.

Referring now to the Figures, and in particular to FIG. 1, container assembly 10 includes container body 12, fitment 14 and cap assembly 16. Container body 12 comprises a plurality of panels 20 and a plurality of seals 22. The panels and seals cooperate to define cavity 26. Of course, the invention is not limited to any particular number of panels and/or seals, or, a container body having any particular geometric configuration. For example, the container body may comprise a pillow-type container, or may comprise a gusseted container, among others. Opening 24 is provided on one of panels 20, or is created by a merging of a plurality of panels 20 proximate one or more of seals 22. Opening 24 provides ingress into cavity 26.

Figure 8:
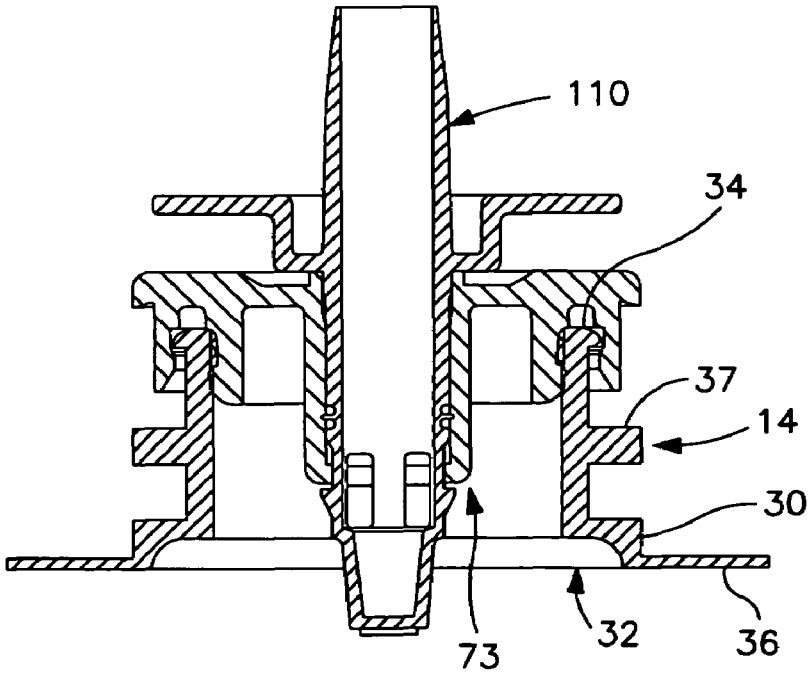
FIG. 8 of the drawings comprises a cross-sectional view of the fitment and cap assembly of the present invention, showing, in particular, the attachment of a probe thereto.

An exemplary fitment 14 is shown in FIG. 8 as comprising body 30, base flange 36, and grasping flanges 37. Body 30 extends from first end 32 to second end 34. Base flange 36 extends from body 30 proximate first end 32. The base flange 36 is larger than opening 24, such that the panel surrounding opening 24 is welded to base flange 36, providing a substantially fluid tight connection. Grasping flanges 37 a number of flanges which are configured for grasping and retaining of the fitment by filling equipment, and for retention by other containers in which the container assembly is positioned (i.e., retention of a box of a bag in box container assembly). The fitment may comprise a HDPE material, or a polypropylene material, among others.

Figure 3:
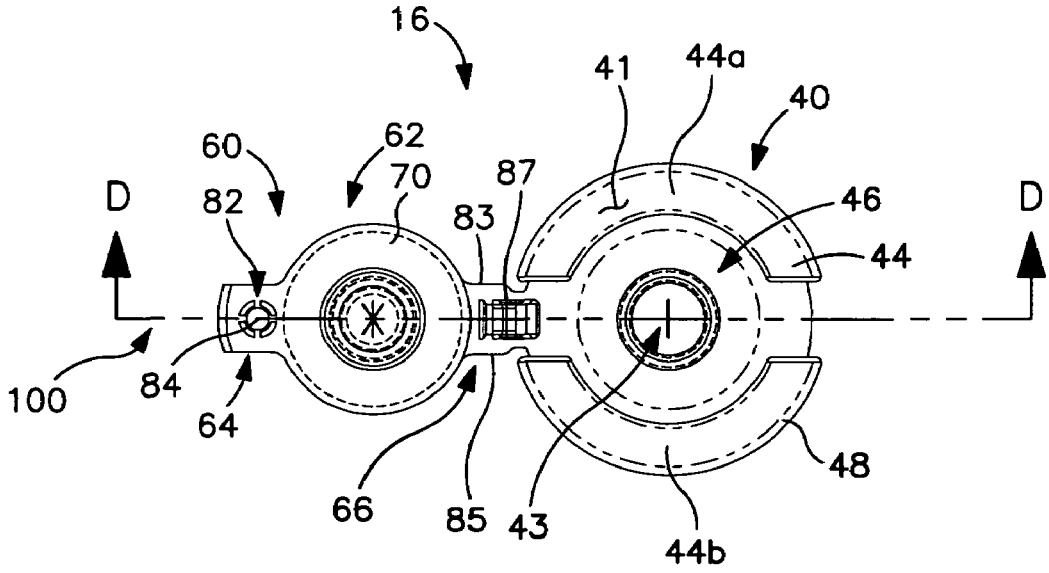
FIG. 3 of the drawings comprises a top plan view of the fitment and cap assembly of the present invention.
Figure 5:
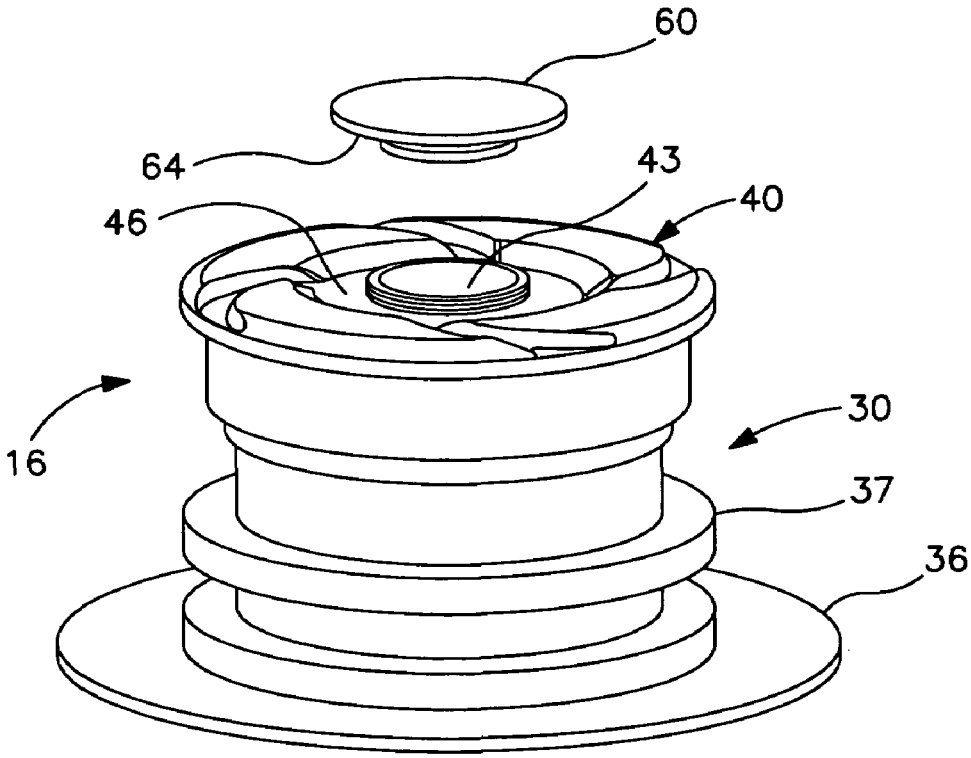
FIG. 5 of the drawings comprise a perspective view of the fitment and cap assembly of an embodiment of the present invention.

An exemplary cap assembly 16 is shown in each of FIGS. 3 and 5 as comprising base 40 and cover 60. With particular reference to cap assembly 16 shown in FIGS. 3 and/or 4, base 40 includes upper surface 41, lower surface 42 and opening 43. Upper surface 41 includes shoulder 44 and valley 46. Shoulder 44 extends at least partially about the outer circumference of base 40. In the embodiment shown, shoulder 44 comprises first shoulder component 44*a* and second shoulder component 44*b*. Each of the shoulder components mirror each other about axis 100, and are spaced apart from each other such that they are each less than pi radians. Of course, other shoulders, having varying components of differing angular length are contemplated for use. In certain embodiments, the shoulder components may extend beyond the outer edge of base 40 so as to define annular rim 48 extending about portions of the base. The cap may comprise polypropylene, PET or PEEK materials, among others.

With reference to the embodiment shown in FIGS. 5 through 8, shoulder 44 may comprise a plurality of shoulder components. As is shown in detail in FIG. 7, the shoulder components 44*a* through 44*d* are separated by arcuate channels 45*a* through 45*d* that extend angularly inwardly toward opening 43. Such arcuate channels are provided to guide steam and other sterilization fluids that are directed at the cap assembly in a circular motion about the outer perimeter of opening 43 along valley 46. Of course the number of arcuate channels can be varied. Moreover, the particular shape (i.e., the radius of curvature of the arcuate channels) can be varied within the scope of the invention.

As is shown in each of FIGS. 3 and 5, valley 46 extends between the shoulder components and substantially surrounds opening 43. In such a configuration, the size of the opening can be varied without requiring a redesign or a restructuring of the shoulder components. In turn, only the surface area of the valley changes as the opening is varied through an entire range of different sizes.

Figure 4:
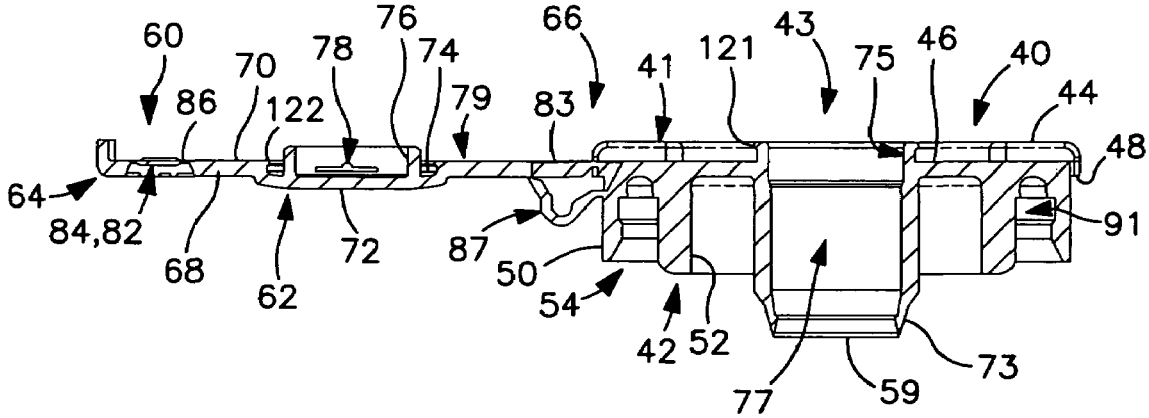
FIG. 4 of the drawings comprises a cross-sectional view of the fitment and cap assembly of the present invention taken generally along lines D-D of FIG. 3.
Figure 6:
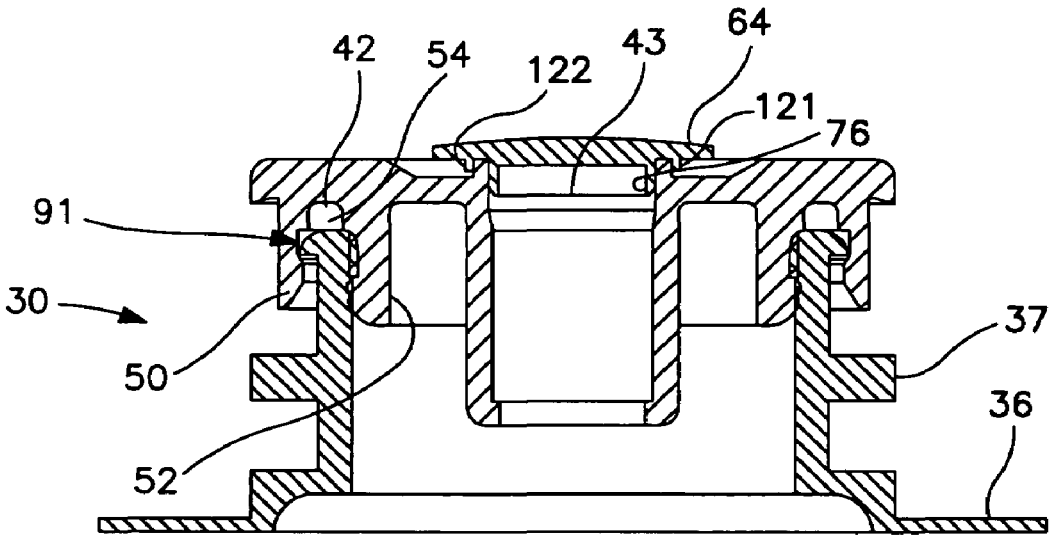
FIG. 6 of the drawings comprises a cross-sectional view of the fitment and cap assembly of an embodiment of the present invention.
Figure 7:
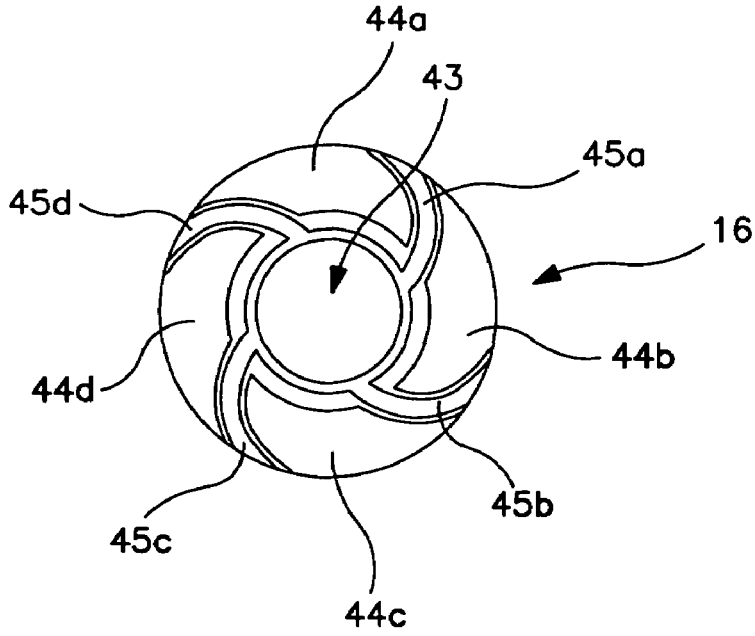
FIG. 7 of the drawings comprises a top plan view of the fitment and cap assembly of an embodiment of the present invention.

Referring now to FIGS. 4 and 6, lower surface 42 of base 40 includes outer retaining annular rim 50 and inner retaining annular rim 52. The two annular rims are substantially concentric and extend outwardly from the lower surface of the base. The two annular rims are separated a distance from each other such that they cooperate to define channel 54 therebetween. Channel 54 is sized so as to facilitate the receipt of second end 34 of body 30 in an interference fit. In certain embodiments, one of the second end of the body and the two annular rims may include a structure which facilitates the positive retained engagement of the fitment, such as retention zone 91 which facilitates positive retained engagement of distal end 32 of fitment 14.

As is shown in FIGS. 4, opening 43 extends through upper surface 41 and lower surface 42. The opening 43, as explained above can have any number of different shapes and sizes. The opening is positioned within valley 46 of the upper surface. Opening 43 includes lower opening annular rim 73 extending about the circumference thereof along lower surface 42. Engagement surface 121 extends outwardly about the outer surface of annular rim 73. Additionally, opening 43 includes upper opening annular rim 75 extending above valley 46 about the circumference thereof along the upper surface 41 thereof. The annular rims are preferably spaced apart so as to create elongated passage 77.

The upper and lower opening annular rims provide enhanced rigidity to opening 43, provide an anchor to which dispensing assemblies may be attached and furthermore in combination with cover 60 providing a sealing assembly (preferably hermetic) for opening 43. For example, as is shown in FIG. 8, probe connector 110 can be coupled to lower opening annular rim 73. In the embodiment shown, the bottom end of probe connector 110 interfaces with the lower opening annular rim 73 so as to preclude release thereof. In other embodiments, a different connector (i.e., a valve, hose, etc.) can be attached and releasably retained thereto under a number of different attachment structures.

In certain embodiments, such as is shown in FIG. 4, a frangible cover 59 can be positioned over opening 43. In particular, the frangible cover precludes passage of material through opening 43. The cover can be broken, peeled or otherwise dislodged from the sealing position when ingress to cavity 26 through opening 43 is desired. In certain embodiments, the frangible cover may be comprise a thin polymer wall that extends across opening 43. The thin polymer wall can be molded into the fitment during molding thereof.

Figure 14:
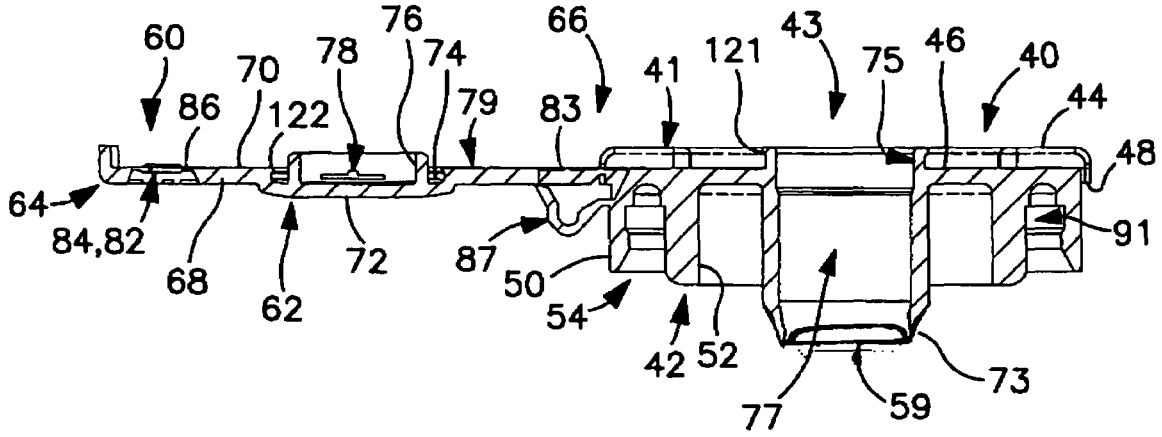
FIG. 14 of the drawings comprises a cross-sectional view of another cap assembly of the present invention.
Figure 15:
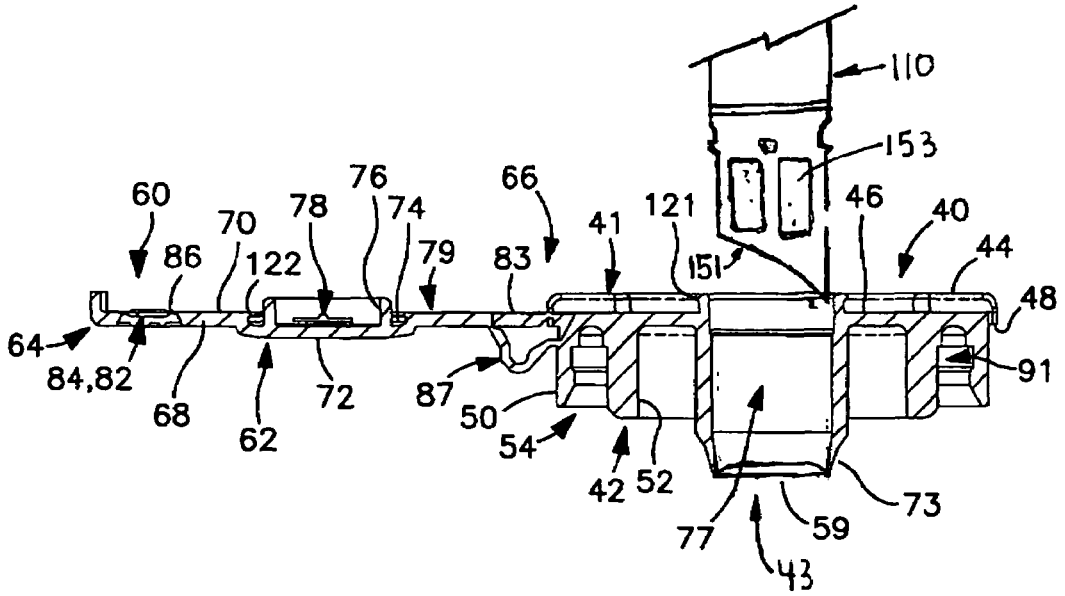
FIG. 15 of the drawings comprises a partial cross-sectional view of the cap shown in FIG. 14, showing in particular, the insertion of the probe toward the frangible cover.
Figure 16:
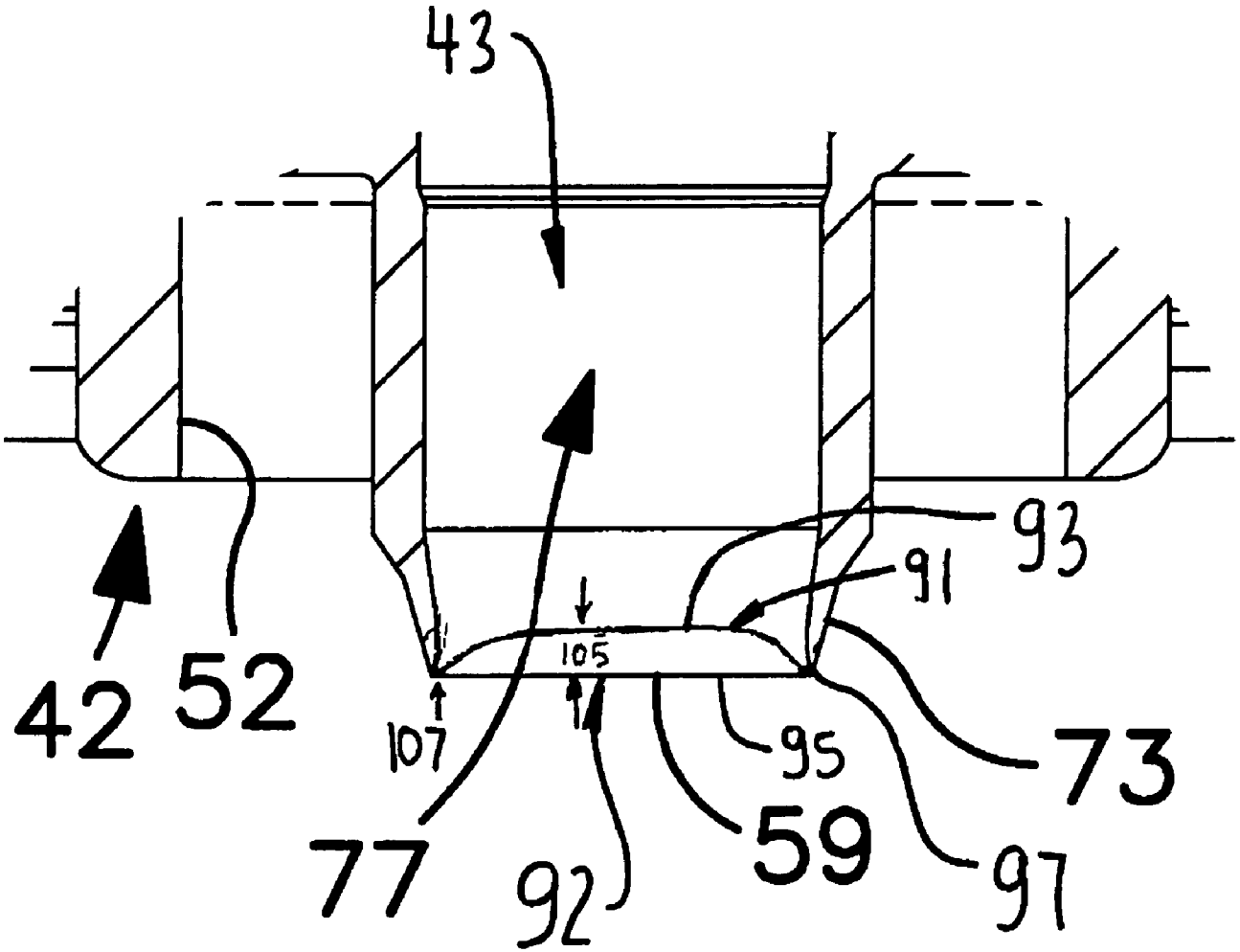
FIG. 16 of the drawings comprises an enlarged partial cross-sectional view of the cap assembly of FIG. 14.

FIGS. 14 through 16 show one such embodiment wherein a thin polymer wall can be molded during the molding of the cap to form frangible cover 59. In particular, and with reference to FIG. 16, such a cover 59 comprises body 91, outer surface 92, inner surface 93, central region 95 and outer perimeter 97. The central region 95 has a central thickness 105. The outer perimeter 97 includes an outer perimeter thickness 107. Thickness 105 of central region 95 is greater than outer thickness 107 of outer perimeter 97. In the preferred embodiment, the thickness of the central region is in excess of twice that of the outer perimeter. Additionally, the predominant portion of the transition between the outer thickness 105 and thickness 107 occurs, preferably, at the outer third of the diameter of body 91, and more preferably in the outer eighth of the diameter of body 91. While the central region is shown as being substantially planar, surface variations in the central region are contemplated, as is a steady taper to the outer perimeter.

With such a configuration of the wall, the frangible cover 59 will typically separate in a single piece from opening 43 when the cap is not exposed to radiation. Wherein gamma irradiation is utilized, polymer materials tend to become brittle and may shatter easily. However, with the above described structural configuration of the frangible cover minimizes the possibility that the frangible cover separates into more than a single member. As a single member, it is larger than the openings 153, 155 (FIG. 15) of probe 110. Thus, upon insertion of the probe into opening 43, the probe breaks the frangible cover and allows for the dispensing from within the flexible container, while precluding the passage of the cover through the opening.

Such a cap of FIGS. 14-16 may be formed through a molding process, wherein the frangible cover 59 is formed by extending the polymer material through a porous mold portion within the overall mold. As such, the cap including the wall can be formed in a single shot mold, thereby saving both time and further expense. Of course, other method of manufacturing are likewise contemplated, such as, for example, coining. As the frangible cover is typically not exposed directly to steam, differing materials may be utilized (i.e., co-molded, separately molded, etc.).

Figure 2:
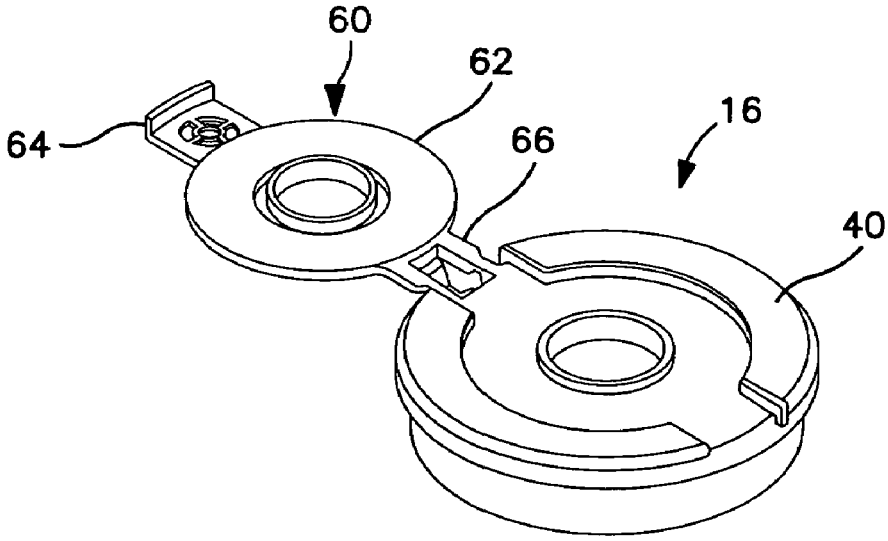
FIG. 2 of the drawings comprises a perspective view of the fitment and cap assembly of the present invention.

Referring now to FIG. 2, cover 60 includes body 62, handle 64 and hinge 66. Cover 60 is configured so as to substantially correspond to the configuration of valley 46. Moreover, the thickness of cover 60 substantially corresponds to the depth of valley 46. Of course variations are likewise considered.

With reference to FIGS. 3 and 4, body 62 includes upper surface 68 and lower surface 70. Upper surface 68 includes domed region 72 positioned thereon. In the embodiment shown, the domed region is positioned in the center of cover 60 and corresponds substantially to the size of opening 43. Lower surface 70 includes outer perimeter region 79, recessed region 74, annular ring 76 and reinforcement member 78. Recessed region 74 is recessed relative to outer perimeter region 79 at engagement ring edge 122. Annular ring 76 is positioned so as to substantially correspond to upper opening annular rim, such that the upper opening annular rim is positionable within the channel defined by the engagement ring edge 122 and the annular ring. When closed, annular ring 76 extends into opening 43 beyond the plane created by valley 46, to, in turn, provide enhanced rigidity to the cap member. Due to the tight tolerances of the respective components, the contact of the annular ring creates a hermetic seal along a portion of the length of the upper and lower annular rim (denoted by the range between A and B of FIG. 13). Preferably the hermetic seal extends to the lower opening annular rim. Advantageously, the cover is selectively removable and replaceable so as to provide a substantially sealed engagement. In turn, the container can be resealed after initial opening thereof and after some of the contents have been withdrawn.

Additionally, as is shown in FIG. 4 (as well as in FIGS. 6 and 13) engagement ring 122 engages against engagement surface 121 of upper opening annular rim 75, to further facilitate engagement of the cap. Certainly, in other embodiments, the annular ring 76 can extend about the upper opening annular rim.

Figure 12:
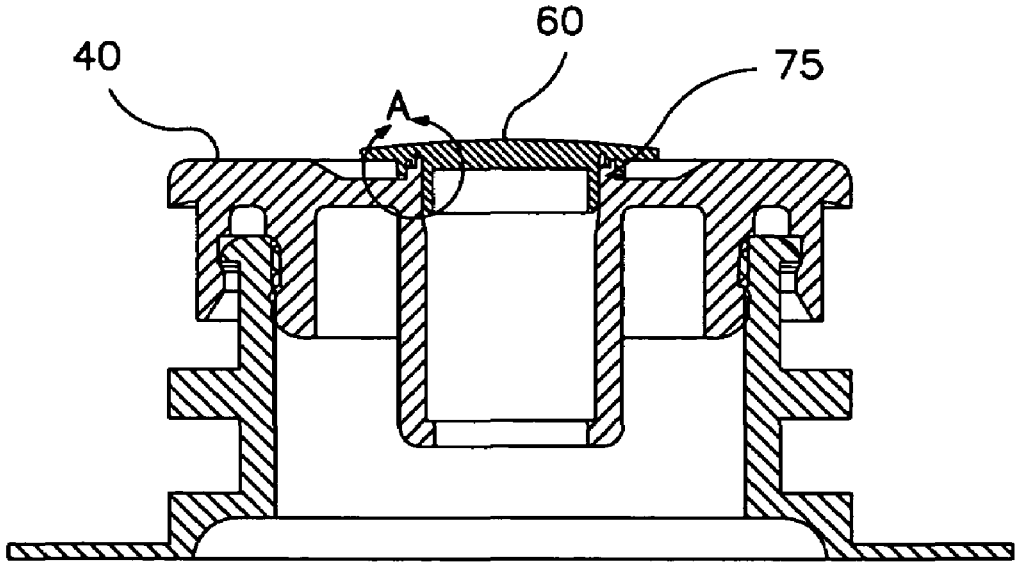
FIG. 12 of the drawings comprises a cross-sectional view of another fitment of the present invention.
Figure 13:
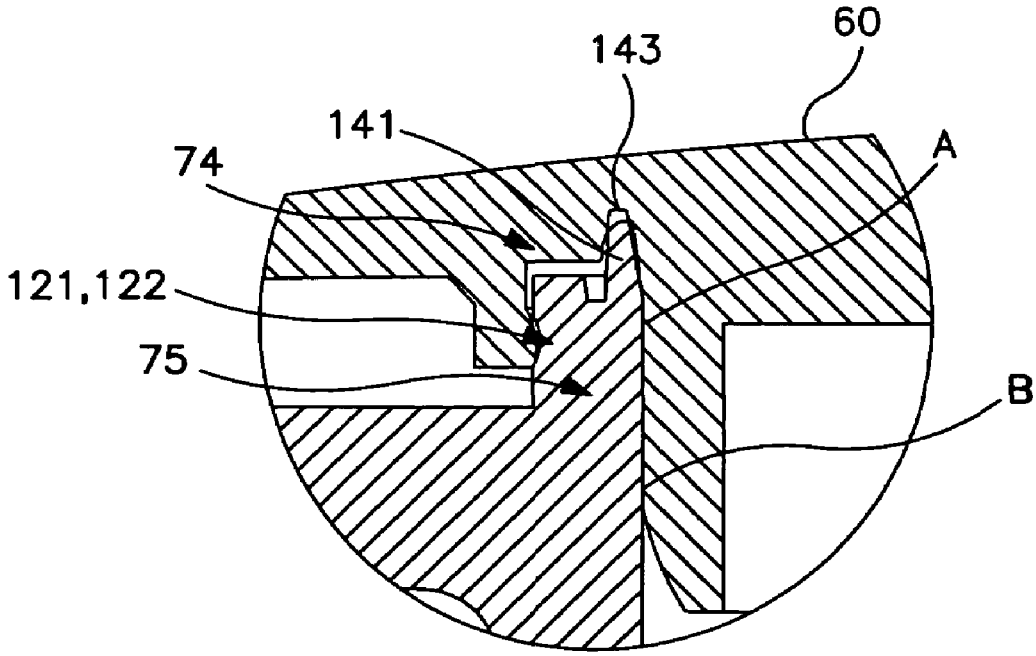
FIG. 13 of the drawings comprises a partial cross-sectional view of the fitment of the present invention taken about close-up region A.

In one embodiment, as is shown in FIGS. 12 and 13, upper opening annular rim 75 further includes ring wedge 141 extending about the outer periphery of the rim. A corresponding channel 143 extends about the recessed region 74 of the lower surface of the cover. Upon application of the cover to the opening, ring wedge 141 extends into corresponding channel 143. The channel and the ring are dimensioned and shaped such that engagement of the components is insured. In turn, a hermetic seal is created therebetween. Advantageously, the application of pressure upon the cover member by the superheated steam only increases contact between the ring wedge and the channel, thereby strengthening the hermetic seal therebetween.

Handle 64 is shown in FIGS. 3 and/or 4 as extending from the cover 60. In the embodiment shown, the handle is positioned between opposing shoulder components 44*a* and 44*b*. Handle 64 provides a means by which to manipulate cover 60 relative to base 40. In the embodiment shown, handle 64 includes tamper evidencing assembly 82. The tamper evidencing assembly comprises plug 84 which is coupled to handle 64 by frangible members, such as frangible members 86. The plug is securable to upper surface 41 of base 40 by way of heat welding, adhering and co-molding, among others. The securement of the plug to the upper surface is stronger than the frangible members. Thus, the frangible members will break leaving the plug attached to the upper surface, to, in turn, indicate that the cover has been removed at least one time from the sealed position.

Figure 11:
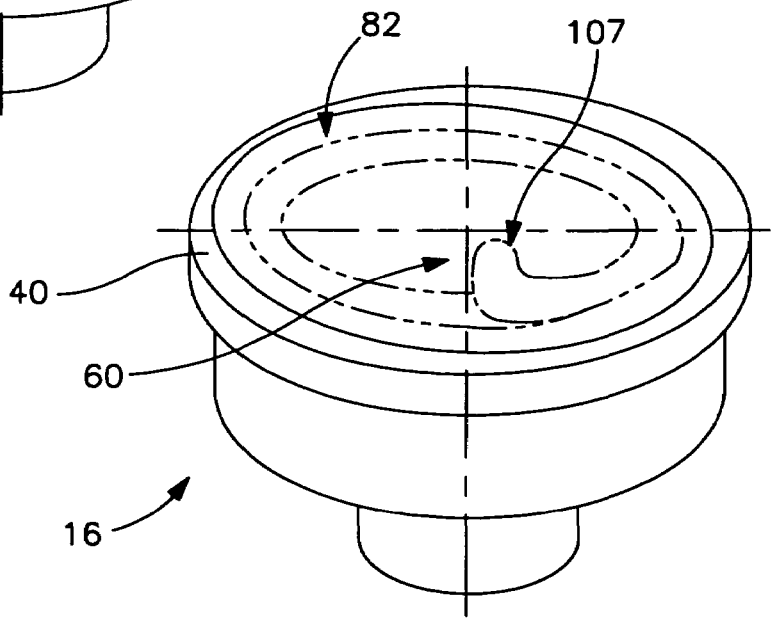
FIG. 11 of the drawings comprises a perspective view of the cap assembly of the present invention.

In another embodiment, as is shown in FIG. 11, tamper evidencing assembly 82 may comprise a frangible tab 107 which is attached to each of the cover and the associated base of the cap member. In the embodiment shown, the frangible tab 107 extends about the full circumference of the cover assembly. Of course, in other embodiments, frangible tab 107 may extend only partially about the circumference of the cover, attaching to the base of the cap assembly at discrete locations.

Hinge 66 is shown in FIGS. 3 and 4 as comprising a live hinge having hinge members 83, 85 and biasing member 87. The hinge members extend on opposing sides of biasing member 87. Each of the members are attached to each of cover 60 and base 40, and comprise an integrally molded live hinge. Of course, other configurations are likewise contemplated for use, including, but not limited to other living hinge configurations, as well as attachment structure which all for greater separation of components.

Figure 9:
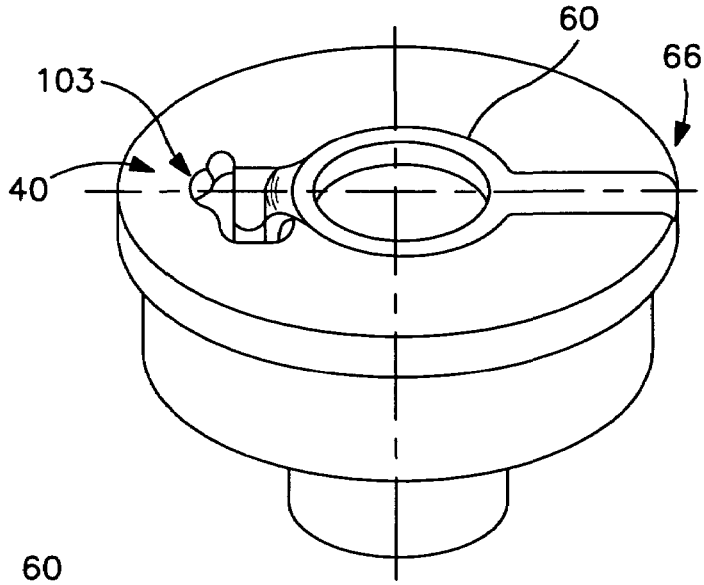
FIG. 9 of the drawings comprises a perspective view of the cap assembly of the present invention.
Figure 10:
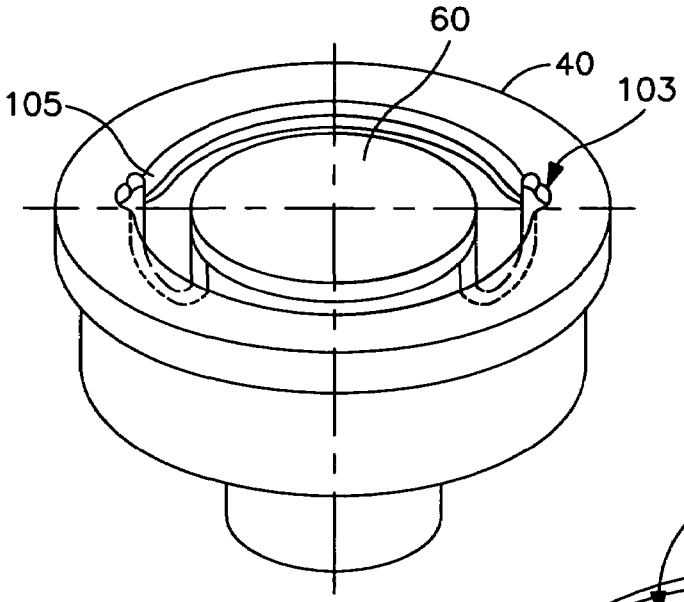
FIG. 10 of the drawings comprises a perspective view of the cap assembly of the present invention.

Referring now to FIG. 10, in other embodiments, the cover may be coupled to the underlying cap assembly by way of releasable engaging members 103, 105. Each engaging member is capable of matingly engaging structures on the cover assembly to releasably retain the cover to the cap assembly. In other embodiments, such as the embodiment shown in FIG. 9, a single engaging member 103 can be utilized in cooperation with hinge 66. The releasable engaging member may be frangibly associated with the cap assembly so as to provide indication as to tampering of the cover relative to the cap assembly.

In other embodiments, such as the embodiment shown in FIGS. 5 through 8, 12 and 13, the hinge can be eliminated, wherein the cover and cap comprise two separate components. In such an embodiment, handle 64 may comprise a flange which extends at least partially on the outside of annular rim 76, to provide a surface by which the cover can be removed.

In operation, the container apparatus is first assembled from a plurality of panels having a plurality of seals positioned thereon. Next, the fitment is coupled to opening 24 of the container. Finally, cap assembly 16 is coupled to the fitment, thereby sealing cavity 26 from fluid communication with the surrounding environment.

Once fully assembled, the container may be gamma irradiated. In typical high acid filling process, the container may undergo approximately 15 kGy of gamma irradiation. In a typical low acid filling process, the container may undergo approximately 30 kGy of gamma irradiation. Of course, the particular quantity of gamma irradiation that is transmitted to the container can be varied without departing from the scope of the invention.

Once irradiated, the cavity is substantially sterilized. The container is next directed to a fill device wherein a chamber is positioned in sealing engagement with at least a portion of the fitment. Once the chamber is sealed to the fitment, a superheated steam is directed onto the fitment and the cover to effectively sterilize the region. For food products, sterilization can be achieved through an application of superheated steam at temperatures generally in excess of 250° F. The higher the temperature, the lower the exposure time needed to achieve sterilization. For example, at 250° F., sterilization is reached in approximately 600 seconds. At 260° F., sterilization is reached in approximately 170 seconds. At 270° F., sterilization is reached in approximately 52 seconds. At 280° F., sterilization is reached in approximately 13 seconds. At 290° F., sterilization is reached in under 4 seconds. At temperatures in excess of 300° F., sterilization is reached in approximately 1 second. Accordingly, to decrease the time necessary for the superheated steam application, the sterilization process generally occurs at temperatures in excess of 280° F.

After the application of superheated steam, the chamber and the contents (i.e., at least a portion of the fitment and the cap assembly) are sterilized. The filling process is then initiated. To initiate the process, the cap assembly is removed from the second end of the fitment 14. Once removed, the fill valve is placed in fluid communication with the fitment, and, the fill material is directed into cavity 26. After filling, the valve is removed and the cap assembly is replaced onto the fitment. Inasmuch as the fitment and the cap assembly remain within the chamber (which is substantially sterilized), the fill process occurs in a substantially sterile environment.

Once recapped, the container can be removed from the filling device and the container is ready for use. In certain embodiments, the container assembly can be inserted into an outer box (i.e., a bag in box). The cover can then be removed from the cap, and the fitment can be attached to a dispensing valve, hose or the like. Due to the unique construction of the cap and the cover, after some of the material within the container has been dispensed, the cover can be repositioned over the cap to effectively seal the container. As such, a resealed container can be stored for future use.

Advantageously, the present fitment and cap assembly are capable of withstanding the sterilization process utilized in association with filling processes wherein the flowable material comprises a low acid food product. The cap and the cover remain firmly positioned upon the fitment and the cap, respectively, and the hermetic seal is maintained throughout the sterilization process.

The foregoing description merely explains and illustrates the invention and the invention is not limited thereto except insofar as the appended claims are so limited, as those skilled in the art who have the disclosure before them will be able to make modifications without departing the scope of the invention.

What is claimed is:

1. A container assembly, comprising:

a container having at least one panel and at least one seal sealing the at least one panel to define a cavity;

a fitment having a base flange welded to the at least one panel of the container, comprising a body having a first end and a second end, the second end extending away from the container, wherein the fitment provides fluid communication with the cavity;

a cap assembly releasably attachable to the second end of the fitment, the cap assembly comprising:

a base having an upper surface, a lower surface and an opening extending therethrough, the upper surface including a shoulder to define a valley therewithin, the lower surface including an outer retaining rim and an inner retaining rim substantially concentrically positioned relative to the outer retaining rim, the outer retaining rim and the inner retaining rim defining a channel structurally configured to retain the second end of the fitment through an interference fit therebetween, the opening including a lower annular rim extending from the lower surface of the base, the lower annular rim defines an elongated passage below the lower surface of the base spaced apart from the inner retaining rim and substantially concentric thereto, and structurally configured to receive and retain a probe;

a cover associated with the base and positioned within the valley of the shoulder and over the opening to, in turn, cover the opening of the base thereby precluding ingress into the elongated passage of the lower annular rim; and a frangible cover integrally molded with the cap extending across the lower annular rim.

2. The container assembly of claim 1 wherein the frangible cover further comprises:

a frangible cover body having a central region and an outer perimeter, wherein the central region includes a central thickness and the outer perimeter includes a outer perimeter thickness, the central thickness is greater than the outer perimeter thickness.

3. The container assembly of claim 2 wherein the central thickness is at least twice that of the outer perimeter thickness.

4. The container assembly of claim 2 wherein the frangible cover body includes a diameter, the body tapers from the central thickness to the outer perimeter thickness predominantly within an outer third of the diameter of the body.

5. The container assembly of claim 4 wherein the tapers from the central thickness to the outer perimeter thickness predominantly within an outer eighth of the diameter of the body.

6. The container assembly of claim 5 wherein the frangible cover is formed by one of directing material through a porous mold and coining.

7. The container assembly of claim 1 wherein the cover comprises:

a body having an upper surface and a lower surface;

an arm extending from the body; and a hinge attached to each of the body and the cap assembly to permit hinged engagement of the cover to the cap assembly.

8. The container assembly of claim 1 wherein the cap assembly is configured for maintaining the hermetic seal after exposure to superheated steam of a temperature of at least 280° F. for a predetermined period of time adequate to achieve sterilization.

9. A cap assembly releasably attachable to the second end of the fitment, the cap assembly comprising:

a base having an upper surface, a lower surface and an opening extending therethrough, the upper surface including a shoulder to define a valley therewithin, the lower surface including an outer retaining rim and an inner retaining rim substantially concentrically positioned relative to the outer retaining rim, the outer retaining rim and the inner retaining rim defining a channel structurally configured to retain the second end of the fitment through an interference fit therebetween, the opening including a lower annular rim extending from the lower surface of the base, the lower annular rim defines an elongated passage below the lower surface of the base spaced apart from the inner retaining rim and substantially concentric thereto, and structurally configured to receive and retain a probe;

a cover associated with the base and positioned within the valley of the shoulder and over the opening to, in turn, cover the opening of the base thereby precluding ingress into the elongated passage of the lower annular rim, and a frangible cover integrally molded with the cap extending across the lower annular rim.

10. The container assembly of claim 9 wherein the frangible cover further comprises:

a frangible cover body having a central region and an outer perimeter, wherein the central region includes a central thickness and the outer perimeter includes a outer perimeter thickness, the central thickness is greater than the outer perimeter thickness.

11. The container assembly of claim 10 wherein the central thickness is at least twice that of the outer perimeter thickness.

12. The container assembly of claim 10 wherein the frangible cover body includes a diameter, the body tapers from the central thickness to the outer perimeter thickness predominantly within an outer third of the diameter of the body.

13. The container assembly of claim 12 wherein the tapers from the central thickness to the outer perimeter thickness predominantly within an outer eighth of the diameter of the body.

14. The container assembly of claim 13 wherein the frangible cover is formed by one of directing material through a porous mold and coining.

15. The cap assembly of claim 9 wherein the cover comprises:

a body having an upper surface and a lower surface;

an arm extending from the body; and a hinge attached to each of the body and the cap assembly to permit hinged engagement of the cover to the cap assembly.

16. The cap assembly of claim 9 wherein the cap assembly is configured for maintaining the hermetic seal after exposure to superheated steam of a temperature of at least 280° F. for a predetermined period of time adequate to achieve sterilization.

17. A method of utilizing a container assembly, the method comprising the steps of:

providing a container assembly filled with a flowable material comprising:

a container having at least one panel and at least one seal sealing the at least one panel to define a cavity;

a fitment having a base flange welded to the at least one panel of the container, comprising a body having a first end and a second end, the second end extending away from the container, wherein the fitment provides fluid communication with the cavity;

a cap assembly releasably attachable to the second end of the fitment, the cap assembly comprising:

a base having an upper surface, a lower surface and an opening extending therethrough, the upper surface including a shoulder to define a valley therewithin, the lower surface including an outer retaining rim and an inner retaining rim substantially concentrically positioned relative to the outer retaining rim, the outer retaining rim and the inner retaining rim defining a channel structurally configured to retain the second end of the fitment through an interference fit therebetween, the opening including a lower annular rim extending from the lower surface of the base, the lower annular rim defines an elongated passage below the lower surface of the base spaced apart from the inner retaining rim and substantially concentric thereto, and structurally configured to receive and retain a probe;

a cover associated with the base and positioned within the valley of the shoulder and over the opening to, in turn, cover the opening of the base thereby precluding ingress into the elongate passage of the lower annular rim; and a frangible cover integrally molded with the cap extending across the lower annular rim;

positioning the cover in a second open orientation relative to the opening of the base;

forcing a probe through the opening of the base;

piercing the frangible cover of the cap; and dispensing the flowable material from within the cavity through the probe.

18. The method of claim 17 wherein the step of piercing the frangible cover further comprises the step of separating the frangible cover from the cap in a single piece.

19. The method of claim 17 wherein the step of providing further comprises the step of providing a gamma irradiated container assembly filled with a flowable material.

20. The method of claim 17 wherein the step of providing further comprises the step of providing a container assembly filled with a flowable material, wherein the container was sterilized with steam at a temperature in excess of 280° F.

* * * * *